US006478273B1

(12) United States Patent
McKeirnan, Jr. et al.

(10) Patent No.: US 6,478,273 B1
(45) **Date of Patent: *Nov. 12, 2002**

(54) WALL TACK

(75) Inventors: Robert D. McKeirnan, Jr., Westlake Village, CA (US); Russell B. Spencer, Cerritos, CA (US)

(73) Assignee: Matrix Innovative Products, Cerritos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/861,385

(22) Filed: May 18, 2001

(51) Int. Cl.[7] ..... A47B 96/06

(52) U.S. Cl. ..... 248/217.3; 248/216.1; 248/684; 24/67 P

(58) Field of Search ..... 248/684, 546, 248/216.4, 216.1, 217.1, 217.3, 218.1, 218.2, 218.3, 304, 339, 302, 303; 24/67 P

(56) References Cited

U.S. PATENT DOCUMENTS

| | | | | |
|---|---|---|---|---|
| 165,206 A | | 7/1875 | Brown | 248/489 |
| 770,163 A | | 9/1904 | Cobb | 248/217.2 |
| 1,272,696 A | | 7/1918 | Mock | 411/460 |
| 2,282,631 A | | 5/1942 | Winship | 411/516 |
| 2,693,927 A | | 11/1954 | Gardner | 248/263 |
| 3,063,669 A | | 11/1962 | Bell | 248/549 |
| 3,273,844 A | * | 9/1966 | Hodson et al. | 248/216.1 |
| 3,966,157 A | | 6/1976 | Corral et al. | 248/217.3 |
| 4,422,608 A | * | 12/1983 | Hogg | 248/205.4 |
| 5,269,485 A | * | 12/1993 | Dwinell et al. | 248/216.4 |
| 5,730,413 A | * | 3/1998 | Chen | 248/489 |
| 6,126,126 A | | 10/2000 | McKiernan, Jr. | 248/217.3 |

FOREIGN PATENT DOCUMENTS

| | | | |
|---|---|---|---|
| EP | 0 666 554 A1 * | 4/1994 | |
| FR | 1067111 | 6/1954 | 248/497 |
| GB | 676903 | 8/1952 | 248/497 |

* cited by examiner

*Primary Examiner*—Leslie A. Braun
*Assistant Examiner*—Gwendolyn Baxter
(74) *Attorney, Agent, or Firm*—Kelly Bauersfeld Lowry & Kelley, LLP

(57) ABSTRACT

An improved wall tack is provided for quick and easy mounting onto an upholstered wall surface or the like for supporting documents such as memoranda, pictures, calendars, etc. The wall tack comprises a plastic molded tack body having a hanger hook protruding from a front side thereof, and a lower prong or push pin projecting rearwardly from a lower margin at a rear side thereof. The rear side of the tack body further includes an elongated recessed groove lined by a plurality of undercut lock tabs for secure snap-fit reception of an elongated wire member having opposite ends defining a pair of rearwardly projecting pointed prongs at an upper margin of the tack body rear side. The pair of pointed prongs cooperate with the lower push pin for engaging and securely supporting the tack body on the upholstered wall surface.

16 Claims, 3 Drawing Sheets

FIG. 1
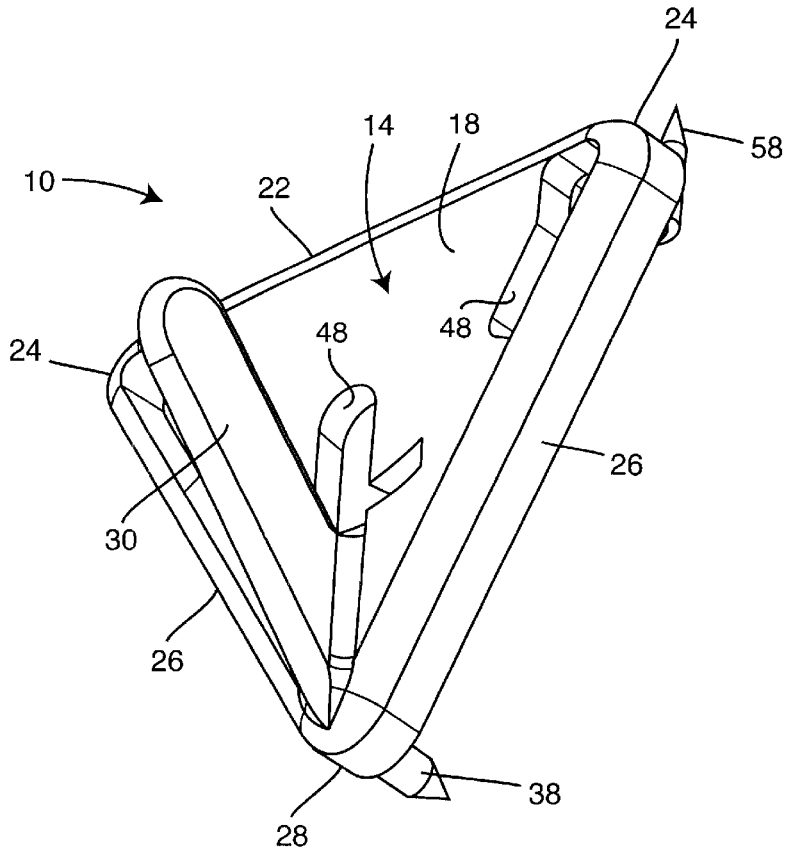
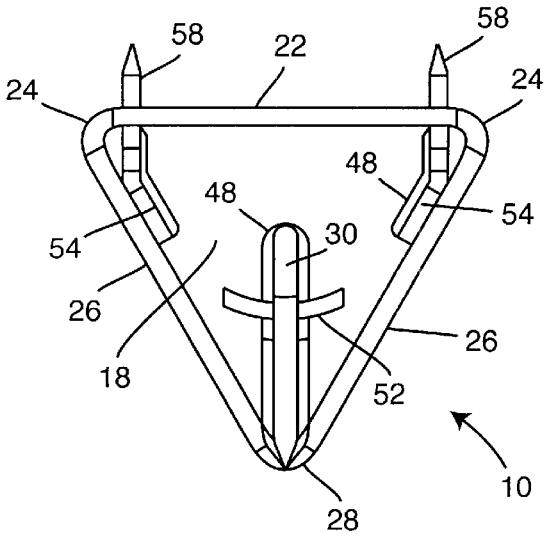
FIG. 4
FIG. 5
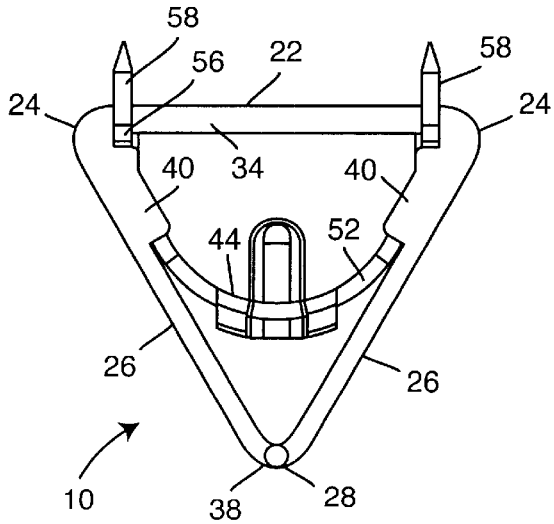

WALL TACK

BACKGROUND OF THE INVENTION

This invention relates generally to improvements in wall tacks and push pins of the general type used for affixing documents such as notes, memoranda, photographs and other pictures, and calendars and the like to upholstered or similar soft-surfaced walls used in office cubicle walls and partitions. More particularly, this invention relates to an improved wall tack designed for quick and easy attachment to an upholstered wall surface or the like, wherein the wall tack is constructed from a minimum number of components adapted for rapid and economical manufacture.

Office cubicle walls and/or partitions commonly comprise an upholstered or fabric or other soft-surfaced or padded material mounted on a suitable support frame or substrate. This wall structure accommodates versatile office floor plans while additionally providing sound attenuation between adjoining work spaces. Push pins or tacks are frequently inserted or pressed into the wall structure by office personnel to hang work related documents such as office papers, calendars and schedules, and address lists, as well as personal items such as photographs and the like.

In many instances, the upholstered wall surface lacks sufficient structural integrity to support items having any significant weight. As a result, items supported from the wall surface have an annoying tendency to fall unexpectedly to the floor. Moreover, conventional push pins have a tendency to work loose even when used to support relatively lightweight items, particularly in response to periodic bumping displacement of the push pins or the supported item, resulting again in occasional unexpected falling of the push pin and supported item to the floor.

U.S. Pat. No. 6,126,126 discloses an improved wall tack for supporting a document or the like from an upholstered wall surface, wherein the wall tack comprises a plastic tack body with an internal metal reinforcement comolded within a forwardly projecting hanger hook, and at least two rearwardly projecting metal prongs formed at the opposite ends of a wire segment which is comolded within the tack body. While this improved wall tack is designed for quick and easy mounting onto an upholstered wall surface or the like, and is capable of supporting a significantly larger weight in a secure and stable manner in comparison with a conventional push pin, the metal-plastic comolded construction of the wall tack results in disadvantageous manufacturing complexities and costs.

There exists, therefore, a need for further improvements in and to wall tacks of the general type disclosed in U.S. Pat. No. 6,126,126, wherein the wall tack is designed for quick and easy attachment to an upholstered wall surface or the like, and further wherein the wall tack construction is compatible with relatively simple and low cost manufacturing techniques.

The present invention fulfills these needs and provides further related advantages.

SUMMARY OF THE INVENTION

In accordance with the invention, an improved wall tack is provided for quick and easy mounting onto an upholstered wall surface or the like for supporting documents such as memoranda, pictures, calendars, etc. The wall tack comprises a plastic molded tack body having a hanger hook protruding from a front side thereof, and a pointed lower prong or push pin projecting rearwardly from a lower margin at a rear side thereof. The rear side of the tack body further includes an elongated recessed groove lined by a plurality of undercut lock tabs for secure snap-fit reception of an elongated wire member having opposite ends defining a pair of rearwardly projecting pointed prongs at an upper margin of the tack body rear side. The pair of pointed prongs cooperate with the lower push pin for engaging and securely supporting the tack body on the upholstered wall surface.

In a preferred form, the pair of pointed upper prongs each extend rearwardly and then turn angularly upwardly relative to the tack body, when said wire member is snap-fit assembled with the tack body. The lower push pin preferably is formed integrally with the plastic molded tack body and projects rearwardly therefrom, although in an alternative form the lower push pin may comprise a separately mounted metal pin or the like. The tack body has a generally triangular shape defining two upper corners with the upper prongs respectively extending rearwardly and angularly upwardly therefrom, and a lower corner with the lower push pin extending rearwardly therefrom. The assembled wall tack is mounted onto the upholstered wall surface by angularly oriented the tack for press-fit or push-in engagement of the upper prongs with the wall surface, followed by downward rotation of the tack body for engaging the lower push pin with the wall surface in a similar press-fit or push-in manner.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view showing the front, right and bottom sides of an improved wall tack embodying the novel features of the invention;

FIG. 4 is a front elevation view thereof

FIG. 5 is a rear elevation view thereof;

DETAILED DESCRIPTION OF THE PREFERRED EMBODIMENT

Figure 2:
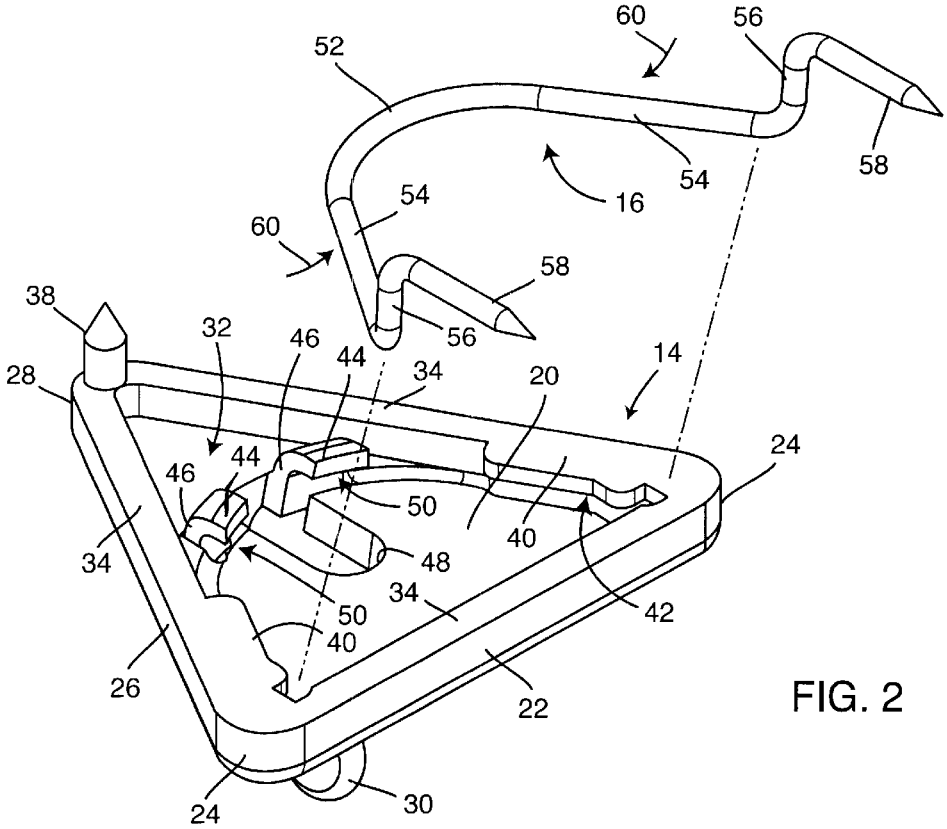
FIG. 2 is an exploded rear perspective view of the wall tack shown in FIG. 1.

As shown in the exemplary drawings, an improved wall tack is referred to generally in FIGS. 1–7 by the reference numeral 10, for use in supporting documents and other items such as memoranda, photographs, calendars and the like from an upholstered wall surface 12 (FIGS. 6–7) or the like. The wall tack 10 generally comprises a plastic molded tack body 14 adapted for quick and easy assembly with a wire member 16 (FIG. 2) to form a compact three-pronged device designed for quick and easy attachment to the upholstered wall surface 12.

The improved wall tack 10 of the present invention is particularly designed for use in hanging documents and/or personal items from an upholstered or similarly soft-surfaced wall structure 12 of the type used commonly in an office cubicle or office partition. More particularly, such soft-surfaced wall structures 12 typically comprise a lightweight wall frame (not shown) supporting a suitable substrate material which is coated or covered by a relatively sturdy fabric upholstery material. Wall structures of this type are widely used in an office environment due to their versatility in accommodating different and variable office space patterns. The wall structure is frequently used by office personnel to hang a variety of work-related and personnel items. The improved wall tack 10 comprises a relatively compact, cost efficient, and easily used device for quickly and securely hanging such items from the wall surface 12.

Figure 3:
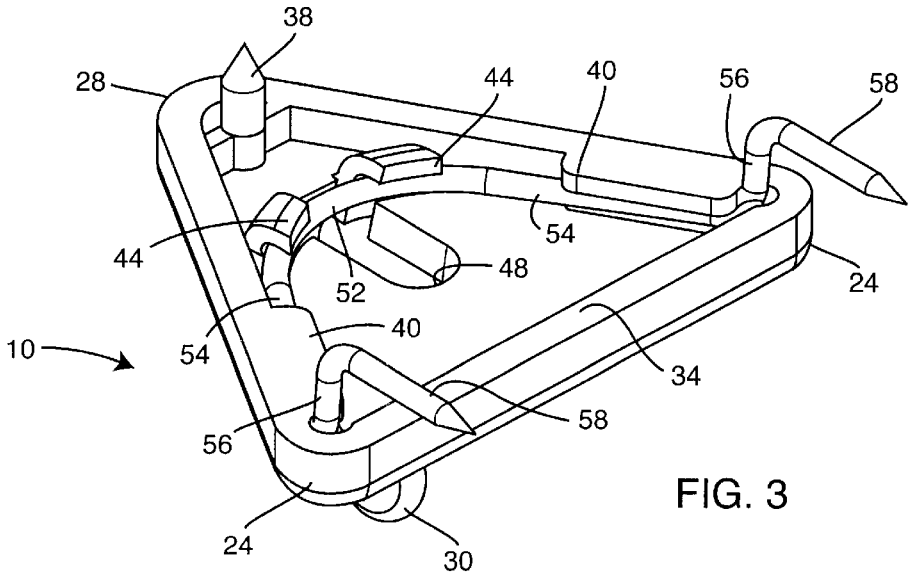
FIG. 3 is a rear perspective view thereof.

The tack body 14 is formed from a lightweight and economically molded plastic material, preferably as a unitary or one-piece molded element. As shown in the illustrative drawings by way of one preferred configuration, the plastic tack body 14 has a generally flat triangular shape defining a front face or side 18 (FIGS. 1 and 4) and a rear face or side 20 (FIGS. 2–3 and 5). This triangular element has a top edge 22 joined at opposite top corners 24 to a pair of downwardly and inwardly angled side edges 26 which terminate at a common lower corner 28. A hanger hook 30 has a base end thereof joined integrally with the tack body front side 18 at a location near the lower corner 28 thereof. This hanger hook 30 projects upwardly and forwardly from the front side 18 for use in hanging support of a document or other selected item, as will be described in more detail.

The rear side 20 of the tack body 14 includes a rearwardly open central shallow cavity 32 of generally triangular shape, bounded by a peripheral rim 34 extending rearwardly a short distance from a generally planar or flat triangular surface of the rear face 20, as viewed best in FIGS. 2–3 and 5. In the illustrative preferred form, a lower pointed tip prong or push pin 38 is formed integrally with the tack body 14 and projects rearwardly from the peripheral rim 34 generally at the lower corner 28. A pair of first lock tabs 40 project inwardly from the peripheral rim 34 at positions near the upper corners 24, and in spaced relation to the rear face 20. Accordingly, the lock tabs 40 cooperate with the rear face 20 to define a corresponding pair of undercuts 42 (FIG. 2).

In the preferred form as shown, the rear face 20 of the tack body 14 additionally supports a pair of second lock tabs 44 at a lower central region thereof. These second lock tabs 44 are carried at the distal ends of a pair of rearwardly extending support posts 46 molded integrally with the tack body 14. As shown, the rear face 20 of the tack body 14 may include one or more apertures 48 formed therein to accommodate the appropriate mold tooling for integral or one-piece molding of the lock tabs 40, 44 in spaced relation to the rear face 20. The second lock tabs 44 thus define a second pair of undercuts 50 (FIG. 2). The first and second lock tabs 40, 44 cooperatively define a partially undercut groove for clip-on or snap-fit mounting of the wire element 16.

The wire member 16 comprises a bent element shaped for quick and easy clip-on and snap-fit assembly with the molded tack body 14. In the preferred form, the wire member comprises a metal wire element having a curved central segment 52 joined at opposite ends to a pair of elongated and generally straight side legs 54. These side legs 54 are respectively joined in turn to a pair of rearwardly extending prong segments 56 joined in turn at the rear ends thereof to a pair of generally upwardly extending upper pointed tip prongs 58. It will be recognized and understood that the wire member may be constructed from alternative materials, such as an elongated plastic spring element, and further may embody alternative end prong segment configurations.

The wire member 16 is assembled with the tack body 14 by squeezing the side legs 54 toward each other, in the direction of arrows 60 in FIG. 2. While holding the wire member 16 is this configuration, the curved central segment 52 can be seated within the undercuts 50 associated with the second lock tabs 44, followed by manual placement of the side legs 54 in alignment with the undercuts 42 associated with the first lock tabs 40. The side legs 54 can then be released, to permit the side legs 54 to spring outwardly into said undercuts 42 and into spring-biased engagement with the inboard sides of the peripheral rim 34. In this position, the rearwardly extending prong segments 56 of the wire member 16 project rearwardly from the tack body 14 respectively at the top corners 24 thereof.

Figure 6:
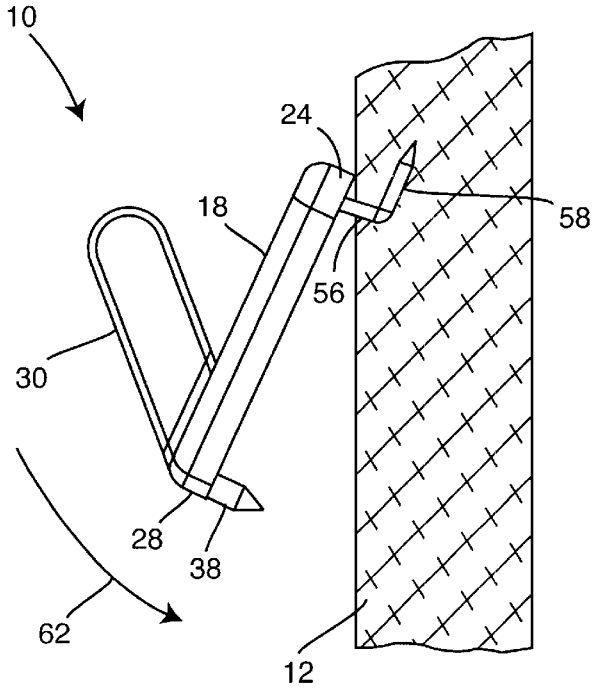
FIG. 6 is a side elevation view depicting installation thereof onto a vertical wall surface.
Figure 7:
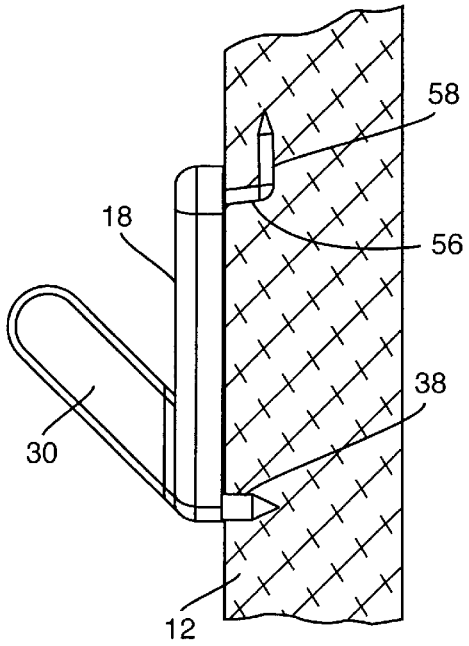
FIG. 7 is a side elevation view similar to FIG. 6, and showing the wall tack in a fully installed position.

FIGS. 6 and 7 illustrate mounting of the assembled wall tack 10 onto the upholstered wall surface 12. As shown, the wall tack 10 is manually held in an angular orientation (FIG. 6) relative to the wall surface 12, to permit the pointed upper prongs 58 at the upper rear margin of the tack body 14 to be pressed or pushed into the wall surface. Concurrently with or immediately following this initial engagement of the pointed upper prongs 58 with the textured wall surface, the wall tack 10 is rotated downwardly in the direction of arrow 62 (FIG. 6) while maintaining the upper prongs 58 in engagement with the wall surface. The wall tack 10 is rotated downwardly until the lower push pin 38 at the lower rear margin of the tack body engages and is pressed or pushed into the wall surface 12, to a final installed position as viewed in FIG. 7. In this position, a selected document or the like can be hung from the wall tack 10 by suitably coupling the document with the front hanger hook 30. In this regard, a hole can be formed in the selected document(not shown), or the document can be held by a conventional spring clip (also not shown), as depicted in U.S. Pat. No. 6,126,126, which is incorporated by reference herein. Alternately, if desired, a suitable hanger wire or strap (not shown) attached to the selected document can be engaged with the hanger hook 30 to support the document. Still further, if desired, the lower push pin 38 may be used to pierce the document and thereby support the document upon attachment of the wall tack to the wall surface.

The improved wall tack 10 of the present invention thus provides a simple device adapted for rapid and economical manufacture, and for subsequent quick and easy attachment to an upholstered wall surface 12 or the like, to support a selected document or personnel item from the wall surface in a secure and stable manner. The wall tack 10 is not easily dislodged from the wall surface in response to routine bumping or other contact during normal office work activities. However, when and if desired, the wall tack can be removed from the wall surface quickly and easily by simply lifting upwardly and forwardly on the lower corner 28 thereof, and then pulling outwardly on the wall tack to withdraw the upper prongs 58 from the wall surface.

A variety of further modifications and improvements in and to the wall tack 10 of the present invention will be apparent to those persons skilled in the art. For example, it will be recognized and understood that the upper prongs 58 may be oriented to extend angularly upwardly and rearwardly from the associated rearwardly projecting prong segments 56, or that these upper prongs 58 may be oriented to extend angularly downwardly and rearwardly from the associated prong segments. Moreover, it will be recognized that the lower push pin 38 may be provided as a separately mounted component formed from metal or other suitable material. Accordingly, no limitation on the invention is intended by way of the foregoing description and accompanying drawings, except as set forth in the appended claims.

What is claimed is:

1. A wall tack, comprising:

a generally flat tack body defining a front face and a rear face;

a hanger hook protruding from said front face of said tack body;

a lower pointed tip prong projecting rearwardly from said rear face of said tack body generally at a lower margin thereof; and an elongated wire member having a pair of upper pointed tip prongs at opposite ends thereof, and a central segment interconnecting said upper prongs;

said rear face of said tack body defining a groove for removably receiving said central segment of said wire member, said upper prongs projecting generally rearwardly from said rear face of said tack body generally at an upper margin thereof when said central segment of said wire member is received within said groove.

2. The wall tack of claim 1 wherein said wire member comprises an elongated metal element.

3. The wall tack of claim 1 wherein said groove defined on said rear face of said tack body comprises a partially undercut groove, said central segment of said wire member being springably deformable for substantially snap-fit reception into said partially undercut groove.

4. The wall tack of claim 3 further including a plurality of lock tabs formed on said tack body in positions spaced rearwardly from said rear face of said tack body, said lock tabs cooperating with said rear face of said tack body to define said partially undercut groove.

5. The wall tack of claim 1 wherein said lower prong comprises a rearwardly projecting push pin.

6. The wall tack of claim 5 wherein said rearwardly projecting push pin is formed integrally with said tack body.

7. The wall tack of claim 1 wherein said tack body, said hanger hook, and said lower prong comprise a unitary plastic molding.

8. The wall tack of claim 1 wherein upper prongs each extend generally rearwardly and then turn generally upwardly relative to said tack body, when said wire member is received within said groove.

9. The wall tack of claim 1 wherein said tack body has a generally triangular shape defining a pair of spaced-apart upper corners and a lower corner, said lower prong extending generally rearwardly from said lower corner of said tack body, and said upper prongs respectively extending generally rearwardly from said upper corners of said tack body.

10. A wall tack, comprising:

a tack body defining a generally flat front face and a generally flat rear face, said tack body having a generally triangular shape defining a pair of spaced-apart upper corners and a lower corner, a hanger hook protruding from said front face of said tack body, and a lower pointed tip prong projecting rearwardly from said rear face of said tack body generally at a lower margin thereof, said tack body and said hanger hook and said lower prong being formed as a unitary plastic molding; and an elongated wire member having a pair of upper pointed tip prongs at opposite ends thereof, and a central segment interconnecting said upper prongs;

said rear face of said tack body defining a groove for seated reception of said central segment of said wire member in a position with said upper prongs projecting generally rearwardly from said upper corners of said tack body.

11. The wall tack of claim 10 wherein said wire member comprises an elongated metal element.

12. The wall tack of claim 10 wherein said groove defined on said rear face of said tack body comprises a partially undercut groove, said central segment of said wire member being springably deformable for substantially snap-fit reception into said partially undercut groove.

13. The wall tack of claim 12 further including a plurality of lock tabs formed on said tack body in positions spaced rearwardly from said rear face of said tack body, said lock tabs cooperating with said rear face of said tack body to define said partially undercut groove.

14. The wall tack of claim 10 wherein said lower prong comprises a rearwardly projecting push pin.

15. The wall tack of claim 10 wherein upper prongs each extend generally rearwardly and then turns generally upwardly relative to said tack body, when said wire member is received within said groove.

16. The wall tack of claim 10 wherein said wire member comprises said central segment having a curved shape and joined at opposite ends thereof to a pair of generally straight side legs, said side legs being joined in turn respectively to said upper prongs, and further including at least one lock tab formed in rearwardly spaced relation to said rear face of said tack body to define an undercut for snap-fit reception of said central segment of said wire member, a peripheral rim extending rearwardly from said rear face of said tack body, and a pair of lock tabs projecting inwardly from said peripheral rim generally at opposite side edges of said tack body and in spaced relation with said rear face of said tack body, said pair of lock tabs cooperating with said peripheral rim and rear face of said tack body to define undercuts for respective snap-fit reception of said side legs of said wire member.

* * * * *